US012219990B2

(12) United States Patent
Kurbanov

(10) Patent No.: US 12,219,990 B2
(45) Date of Patent: Feb. 11, 2025

(54) MULTI-COMPARTMENT SMOKING PIPE

(71) Applicant: Vladislav A Kurbanov, Chicago, IL (US)

(72) Inventor: Vladislav A Kurbanov, Chicago, IL (US)

( * ) Notice: Subject to any disclaimer, the term of this patent is extended or adjusted under 35 U.S.C. 154(b) by 500 days.

(21) Appl. No.: 17/567,810

(22) Filed: Jan. 3, 2022

(65) Prior Publication Data

US 2022/0211098 A1 Jul. 7, 2022

Related U.S. Application Data

(60) Provisional application No. 63/133,811, filed on Jan. 5, 2021.

(51) Int. Cl.
*H04W 56/00* (2009.01)
*A24F 1/28* (2006.01)

(52) U.S. Cl.
CPC ..... *A24F 1/28* (2013.01)

(58) Field of Classification Search
None
See application file for complete search history.

(56) References Cited

U.S. PATENT DOCUMENTS

2018/0228211 A1* 8/2018 Eckhoff ..... A24F 5/10

* cited by examiner

*Primary Examiner* — Phu H Nguyen
(74) *Attorney, Agent, or Firm* — Justin Lampel

(57) ABSTRACT

A multi-compartment smoking pipe is provided. The multi-compartment smoking pipe not only stores smokable substances, but further allows a user to smoke a predetermined amount of smokable substance. The pipe has multiple compartments wherein a user can smoke the smoking material in one compartment while the smoking material in the other compartments remains undisturbed. The multi-compartment smoking pipe allows for a user to select from different smokable substances.

14 Claims, 6 Drawing Sheets

MULTI-COMPARTMENT SMOKING PIPE

CROSS REFERENCE TO RELATED APPLICATIONS

The following application is a based on and claims the priority benefit of U.S. provisional application Ser. No. 63/133,811 filed Jan. 5, 2021 currently; the entire content of which is incorporated by reference.

BACKGROUND OF THE INVENTION

A multi-compartment smoking pipe is provided. The multi-compartment smoking pipe not only stores smokable substances (such as tobacco), but further allows a user to smoke a predetermined amount of smokable substance. The pipe has multiple compartments wherein a user can smoke the smoking material in one compartment while the smoking material in the other compartments remains undisturbed. The multi-compartment smoking pipe allows for a user to select from different smokable substances.

Smoking pipes are common. For example, U.S. Pat. No. 9,795,164 to Hood discloses a smoking pipe with a jacket containing an inner glass tube. The glass tube has a hole in its wall that aligns with a hole in the jacket. The pipe has a bowl holder that holds a glass bowl with a stem that extends proximate to the hole in the glass tube. The joint between the bowl stem and an insert in the bowl holder can form a frosted glass fitting. End-caps with threaded inserts can match glass threads on the ends of the glass tube holding the glass tube in the jacket. A decorated metal bowl holder can be mounted on the jacket and decorated with gems, glass and the like. The pipe can be manufactured using different types of premium woods for the jacket for design and beauty. The use of an inner glass tube that contains the smoke eliminates contamination and cools the smoke for inhalation.

Further, U.S. Pat. No. 9,635,883 to Guardino discloses a body and a smokable substance storage compartment. The body may define a hollow shaft that extends from a first end of the body to a second end of the body. The hollow shaft may terminate at a first opening in the first end of the body and at a second opening in the second end of the body. The pipe may include a reloading slide that is configured to movably engage the body and includes a reloading recess that is configured to receive a portion of a smokable substance from the smokable substance storage compartment. The reloading slide may be configured to align a reloading recess with a portion of the body that provides access to the smokable substance storage compartment or the portion of the body that defines the first opening in the first end of the body.

However, these patents fail to describe a multi-compartment smoking pipe which is easy to use. Further, these patents fail to provide for a multi-compartment smoking pipe which allows a user to smoke a designated amount of smokable substance.

SUMMARY OF THE INVENTION

A multi-compartment smoking pipe is provided. The multi-compartment smoking pipe not only stores smokable substances, but further allows a user to smoke a predetermined amount of smokable substance. The pipe has multiple compartments wherein a user can smoke the smoking material in one compartment while the smoking material in the other compartments remains undisturbed. The multi-compartment smoking pipe allows for a user to select from different smokable substances.

An advantage of the present multi-compartment smoking pipe is that a user may smoke a predetermined amount of smokable material while leaving other smokable material untouched within the pipe.

Another advantage of the present multi-compartment smoking pipe is that the present multi-compartment smoking pipe may act as a storage and transportation device as well as a pipe for smoking smokable material.

Yet another advantage of the present multi-compartment smoking pipe is that the present multi-compartment smoking pipe allows for different types of smokable materials to be stored and smoked.

Still another advantage of the present multi-compartment smoking pipe is that the present multi-compartment smoking pipe has magnets that directly align storage compartments of the device to an air flow hole for smoking the smokable material.

And another advantage of the present multi-compartment smoking pipe is that the present multi-compartment smoking pipe is easy to wash and clean.

Still another advantage of the present multi-compartment smoking pipe is that the present multi-compartment smoking pipe is small, durable, and light-weight.

For a more complete understanding of the above listed features and advantages of the multi-compartment smoking pipe reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

Figure 1:
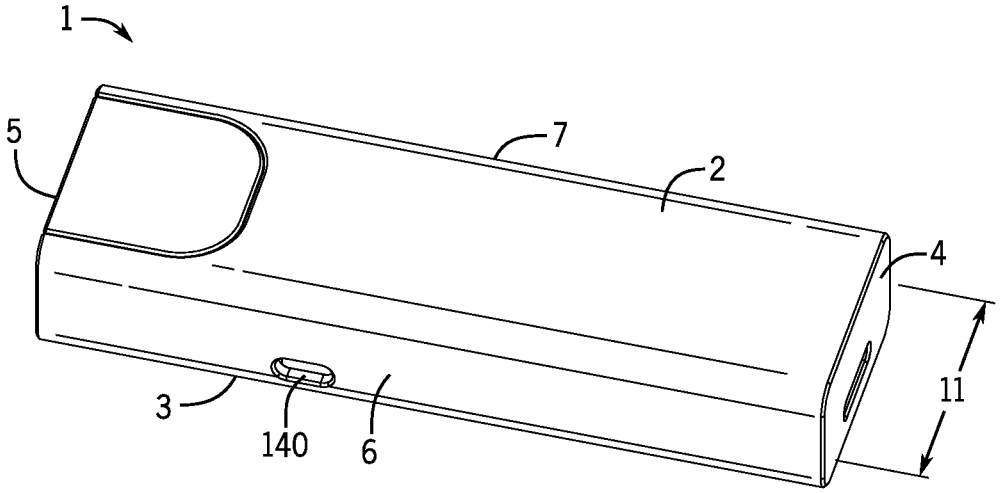
FIG. 1 illustrates a perspective view of the fully assembled multi-compartment pipe wherein the movable storage clip is in the first position and wherein the pipe is in the non-usable storage orientation.
Figure 2:
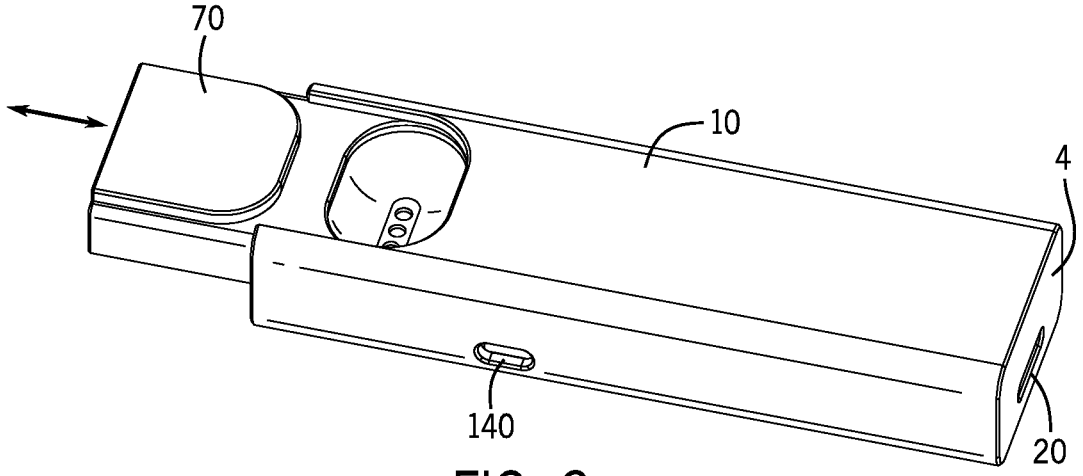
FIG. 2 illustrates a perspective view of the fully assembled multi-compartment pipe wherein the movable storage clip is in a second position.
Figure 3:
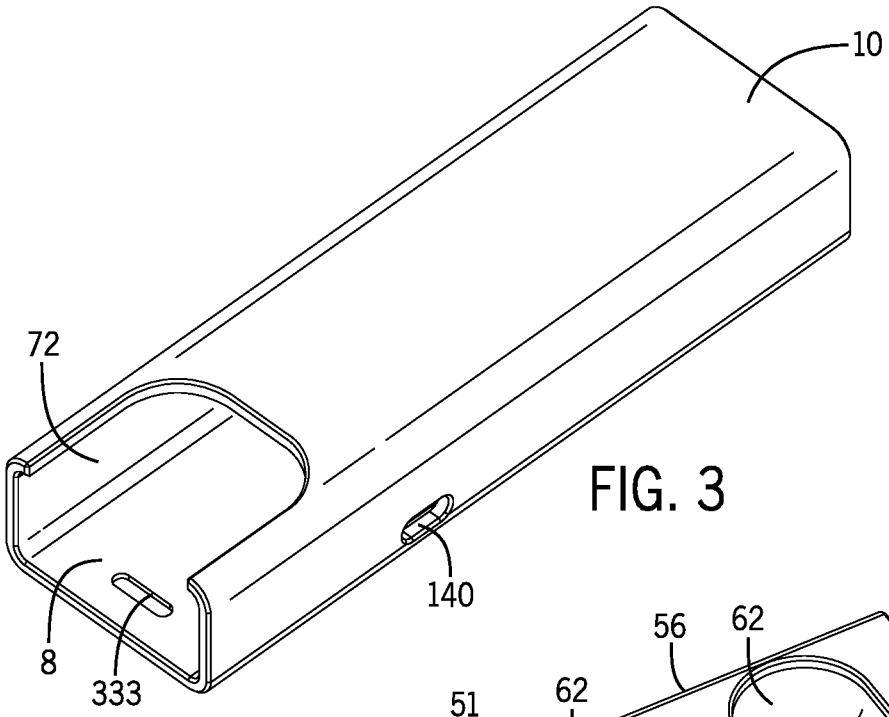
FIG. 3 illustrates a perspective view of the main storage body of the multi-compartment smoking pipe.
Figure 4:
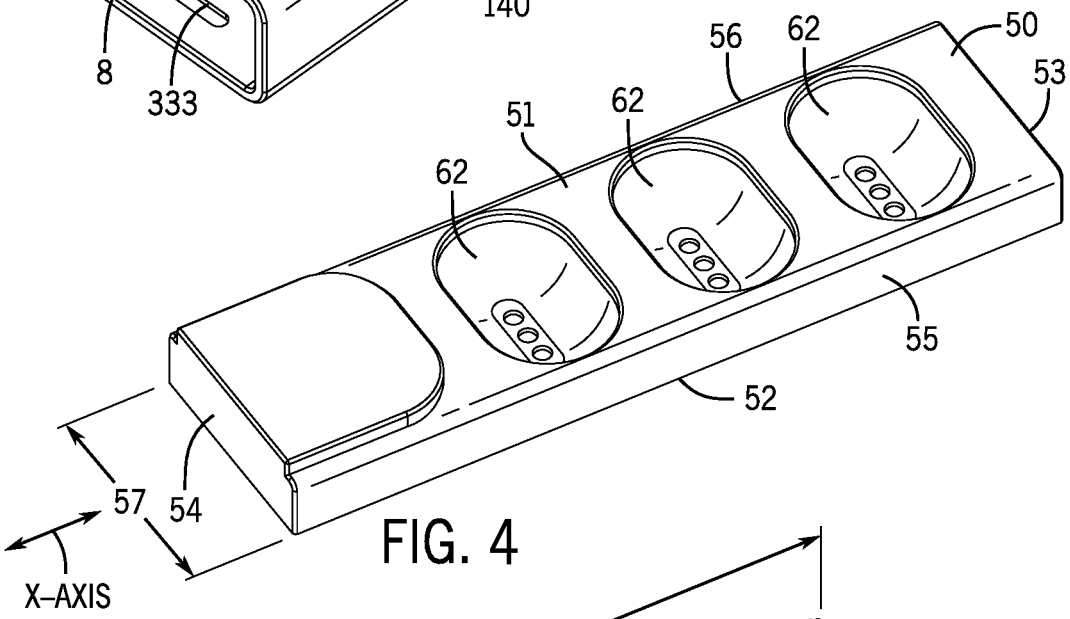
FIG. 4 illustrates a perspective view of the movable storage clip of the multi-compartment smoking pipe.
Figure 5:
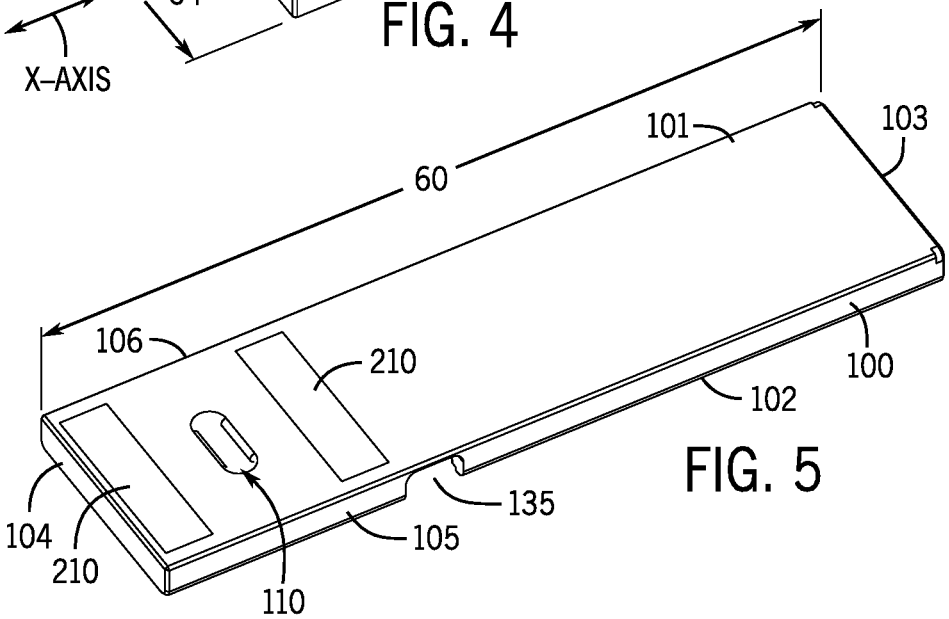
FIG. 5 illustrates a perspective view of the air valve plate of the multi-compartment smoking pipe.
Figure 6:
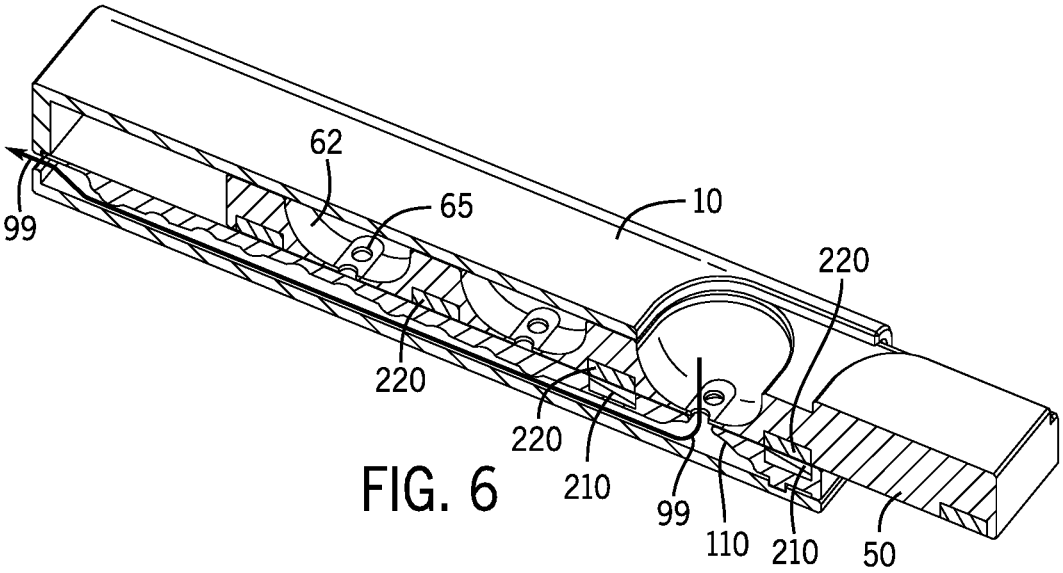
FIG. 6 illustrates the path of air flow from the first compartment through the air valve directly to the mouth tip.
Figure 7:
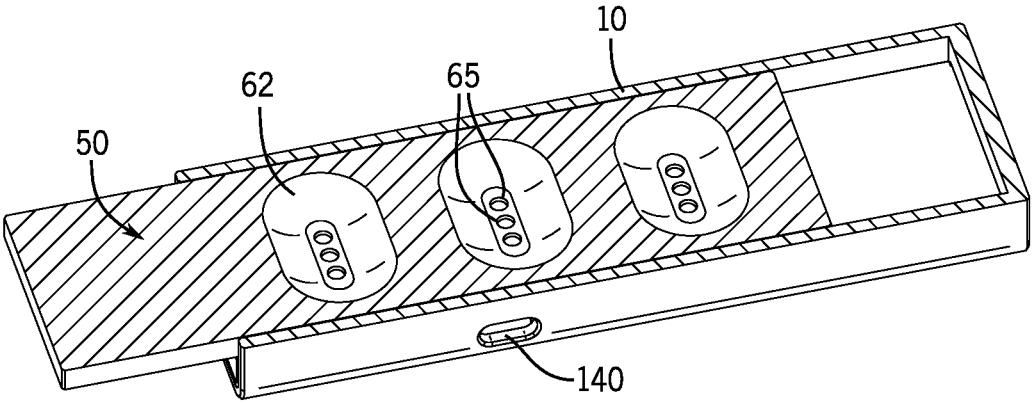
FIG. 7 illustrates a cross-sectional top view of the device (wherein the top of the main storage body missing for illustrative purposes).
Figure 8:
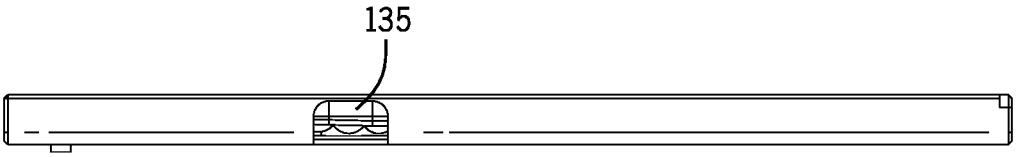
FIG. 8 illustrates a side view of the air valve plate of the multi-compartment smoking pipe.
Figure 10:
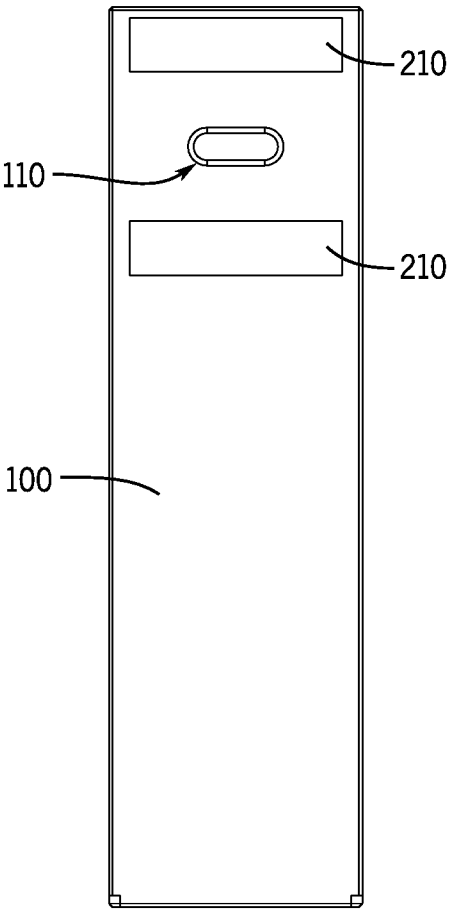
FIG. 10 illustrates a bottom view of the air valve plate of the multi-compartment smoking pipe.
Figure 9:
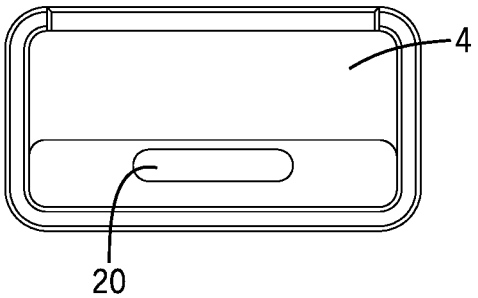
FIG. 9 illustrates a front view of the mouth tip of the multi-compartment smoking pipe.
Figure 11:
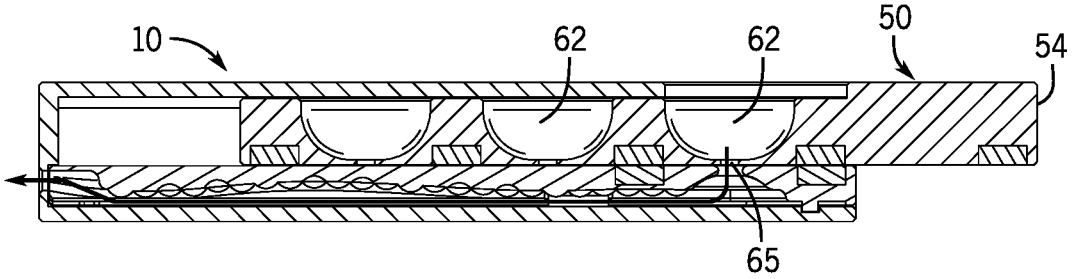
FIG. 11 illustrates cross-sectional view of the path of air flow from the first compartment through the air valve directly to the mouth tip.
Figure 12:
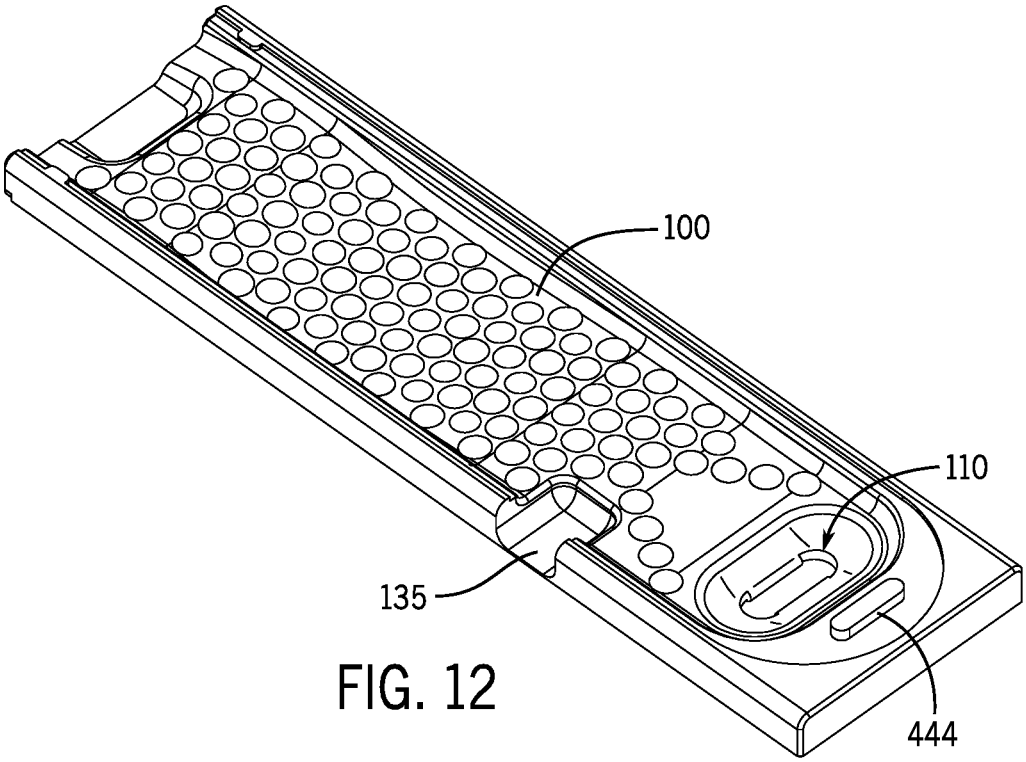
FIG. 12 illustrates a perspective view of the air valve plate of the multi-compartment smoking pipe.

A multi-compartment smoking pipe is provided. The multi-compartment smoking pipe not only stores smokable substances, but further allows a user to smoke a predetermined amount of smokable substance. The pipe has multiple compartments wherein a user can smoke the smoking material in one compartment while the smoking material in the other compartments remains undisturbed. The multi-compartment smoking pipe allows for a user to select from different smokable substances.

Referring first to FIGS. 1-5, in an embodiment, a multi-compartment smoking pipe 1 is provided. The multi-compartment smoking pipe 1 may have a main storage body 10, a movable storage clip 50 and an air valve plate 100. The main storage body 10 may have a top 2, a bottom 3, a front 4, a back 5, a first side 6, a second side 7 and a generally hollow interior 8. In an embodiment, the movable storage clip 50 may move to different positions within, or may be completely removed from the main storage body 10 for cleaning.

The main storage body 10 may have a width 11 which is slightly greater than a width 57 of the movable storage clip 50. The movable storage clip 50 may have a top 51, a bottom 52, a front 53, a back 54, a first side 55 and a second side 56. The width 57 of the movable storage clip 50 may be slightly smaller than the width 11 of the main storage body 10 so that the movable storage clip 50 may fit inside the hollow interior 8 of the main storage body 10.

The movable storage clip 50 may also have a length 60. Running along the length 60 of the movable storage clip 50, at the top 51 of the movable storage clip 50 may be a plurality of hollow compartments 62 that extend downward toward the center of the movable storage clip 50. The figures illustrate a movable storage clip 50 having three hollow compartments 62; however, a greater of fewer number of hollow compartments 62 may be implemented in the design depending on the desired embodiment. The hollow compartments 62 may receive and hold the smokable material (not shown), such as tobacco.

In an embodiment, the device 1 may have an air flow plate 100. The air flow plate 100 may have a top 101, a bottom 102, a front 103, a back 104, a first side 105 and a second side 106. An opening 110 extending from the top 101 to the bottom 102 of the air flow plate 100 may be present on the air flow plate 100, preferably near the back 104 of the air flow plate 100.

In an embodiment, the movable storage clip 50 is located between the top 2 of the main storage housing 10 and the air flow plate 100. The movable storage clip 50 may move along an x-axis with respect to the stationary main storage body housing 10. The movable storage clip 50 may move along the x-axis so that a user may select one of the hollow compartments 62 to align with the opening 110 of the air flow plate 100 so that the smokable material may be smoked. More specifically, at the bottom of each of the hollow compartments 62 may be at least one opening 65 that may receive inflowing air 99 when a lighter is used to light the smokable material and the user pulls in a breath from the device 1. The figures illustrate three openings 65 at the bottom of each of the hollow compartments 62 so that enough air may be exposed to the smokable material in the hollow compartments 62 while still having small holes that prevent the smokable material from falling through the opening 62.

Located on the back 4 of the main storage body housing 10 may be an opening 20. The illustration shows an elongated rectangular opening 20; although various other shaped openings may be used. The opening 20 of the back 4 of the main storage body housing 10 may be the "mouth" opening that a user would place his/her lips to inhale the smoke while using the device 1.

In one embodiment, a plurality of magnets (at different locations) may be used. In particular, a plurality of magnets 210 may be present on the air flow plate 100. In an embodiment, a first magnet 210 and a second magnet 210 of the air flow plate 100 may be on opposing sides of the opening 110 of the air flow plate 100. Further, at least one magnet 220 may also be associated with each hollow compartment 62 of the movable storage clip 50 so that a user may perfectly align the movable storage clip 50 with respect to the air flow plate 100 during use. In particular, the magnet(s) 210 of the air flow plate 100 may correspondingly be attracted to the magnet(s) 220 of the movable storage clip 50.

Figure 13:
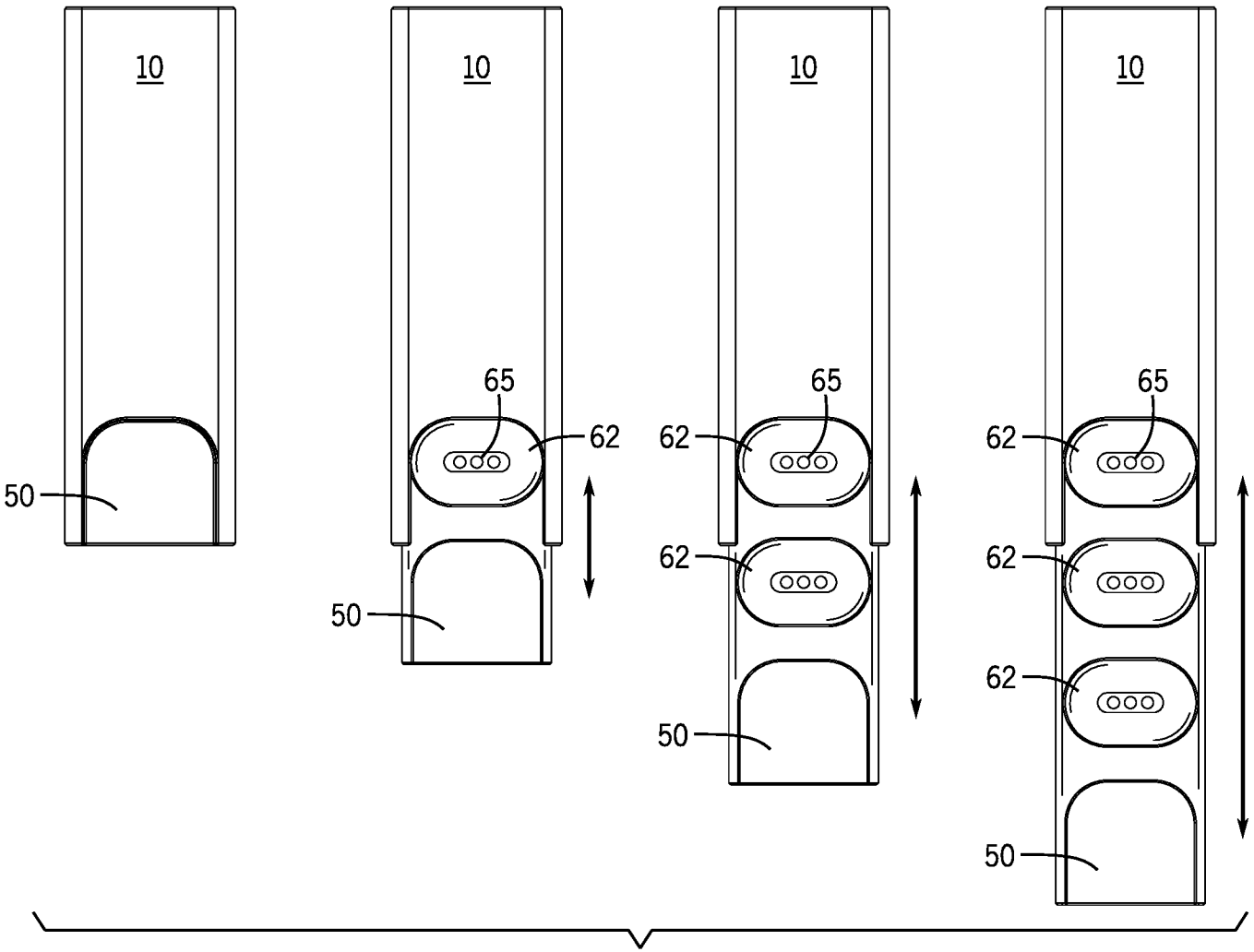
FIG. 13 illustrates the plurality of different positions the device may occupy.

As a user pulls the movable storage clip 50 outward (along the x-axis) from the interior 8 of the main storage body housing 10, the magnets 220 of the movable storage clip 50 aligns with the magnet(s) 210 of the air flow plate 100 of the main storage body housing 10 so that the movable storage clip 50 precisely stops at each hollow compartment 62 and therefore aligns the opening 65 of the storage compartment 62 with the opening 110 of the air flow plate 100. The light attraction of the magnets 220 of the movable storage clip 50 to the magnets 210 of the air flow plate 100 is enough to stop the movable storage clip 50 and align it with the air flow plate 100 of the main storage body housing 10, but not too strong that a user has difficultly overcoming the attractive force by pulling the movable storage clip 50 to an alternative position (see FIG. 13). More specifically, as a user pulls the movable storage clip 50 outward along the x-axis, the movable storage clip 50 is predetermined to lightly stop at and align with each hollow compartment 62.

An elevated thumb pad 70 provides a surface for the user to grasp while pulling the movable storage clip 50 outward from the main storage body housing 10. The elevated thumb pad 70 may have, in one embodiment, a rubber and/or rough surface to make grasping and moving the movable storage clip 50 easier. The elevated thumb pad 70 may rest in a correspondingly shaped u-shaped opening 72 of the front 5 of the main storage body housing 10.

In the closed state of FIG. 1, each compartment 62 is sealed (under the top of the main housing 10) and each compartment 62 may therein safely secure smokable material. In particular, each individual compartment 62 is covered at its top by the underside of the top 2 of the main storage body 10 while the device 1 is in the First Position of FIG. 1. As a compartment 62 is pulled forward, only the compartment 62 located directly over the opening 110 of the air valve place 100 may be used to smoke the material as the other compartments 62 still remain sealed by the housing 10 and the air valve plate 100. More specifically, as a compartment 62 is pulled forward, the openings 65 of that compartment 62 therein align with the opening 110 of the air valve plate 100 while, at the same time, the top of that compartment 62 becomes unobstructed by the underside of the top 2 of the main storage body 10. Therein, a path for air 99 to completely flow through the compartment 62 is established.

To use the device 1, a user applies a flame source to the top of the compartment 62 while pulling air 99 from the mouth opening 20. Air 99 (initially with fire) travels down into the individually selected compartment 62, then through the smokable material within the compartment 62, and then through opening 65 of the compartment 62 and out the device 1 through the mouth opening 20.

A carb hole 135 on the side of the air valve plate 100 aligns with an opening 140 (FIGS. 1 and 2) of the main body 10. The carb hole 135 extends from the top and side of the air valve plate 100. The carb hole 135 allows a user to further regulate the amount of and movement of air 99 through the device 1 to either speed up or slow down the burn rate of the smokable material. More specifically, during use of the device 1 to smoke a material, a user may place his/her finger (or portion of his/her finger) on/over the opening 140 of the main storage body 10 to prevent additional air 99 from flowing through the device 1 to mix with the air 99 already entering the device 1 through the top of the compartments 62 to the mouth piece 20 while smoking the pipe 1. If a user releases his/her finger from the opening 140, air may also pass through the opening 140 (and mix with the air 99 from the top of the compartment 62) while a user is pulling air 99 through the mouth piece 20. If the user's finger is not on the opening 140, the rate of burning decreases. If a user places his/her finger on the opening 140, the burn rate increases. As a result, a user may more easily control the burn rate of the smokable material.

In an embodiment, an opening 333 on the bottom of the main storage body 10 may align with the opening 110 on the air flow plate 100 to allow the flow of air through the device 1 as described above. Finally, in an embodiment, a locking mechanism 444, may extend from the top of the air flow plate 100 and may allow the air flow plate 100 to be removably secured to the main storage body 10 of the device 1.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A multi-compartment smoking pipe comprising:

a main storage body having a front, a back, a first side, a second side, a top, a bottom and a generally hollow interior;

a movable storage clip having a front, a back, a first side, a second side, a top, a bottom and at least one hollow compartment;

wherein the movable storage clip moves from a first position to a second position within the generally hollow interior of the main storage body;

an opening on the main storage body wherein air flows through the opening;

an air flow plate located under the movable storage clip wherein the air flow plate has an opening for allowing the passage of air wherein the air flow plate is located within the main storage body;

and wherein the movable storage clip move from a first position within the main storage body to a second position within the main storage body and wherein in the second position a portion of the movable storage plate is located outside of the interior of the main storage body.

2. The multi-compartment smoking pipe of claim 1 further comprising:

at least one opening at a bottom of each of the hollow compartments of the movable storage clip wherein the opening allows for the passing of air through the movable storage clip.

3. The multi-compartment smoking pipe of claim 1 further comprising:

a first magnet located on an air flow plate of the main storage body.

4. The multi-compartment smoking pipe of claim 3 further comprising:

a second magnet located on the movable storage clip wherein the second magnet of the movable storage clip aligns with the magnet of the air flow plate of the main storage body and therein aligns the movable storage clip with the air flow plate of the main storage body.

5. The multi-compartment smoking pipe of claim 1 further comprising:

at least one opening at a bottom of each of the hollow compartments of the movable storage clip.

6. The multi-compartment smoking pipe of claim 1 further comprising:

an opening on the first side or second side of the main storage body wherein the opening of the first side or second side of the main storage body allows for the passage of air into the generally hollow interior of the main storage body.

7. The multi-compartment smoking pipe of claim 1 further comprising:

an elevated thumb pad located on the top of the movable storage clip.

8. The multi-compartment smoking pipe of claim 1 further comprising:

a second hollow compartment on the movable storage clip.

9. The multi-compartment smoking pipe of claim 1 further comprising:

a locking mechanism on the air flow plate for temporarily locking the air flow plate to the main storage body.

10. The multi-compartment smoking pipe of claim 1 further comprising:

an opening on the side of the air flow plate wherein the opening of the side of the air flow plate allows for the passage of air through the main storage body when the air flow plate is inserted into the main storage body.

11. The multi-compartment smoking pipe of claim 1 wherein the movable storage plate moves along linear x-axis with respect to the main storage body: wherein the back and front of the movable storage clip are on the x-axis.

12. The multi-compartment smoking pipe of claim 1 further comprising:

an elevated thumb pad on the movable storage clip.

13. The multi-compartment smoking pipe of claim 12 wherein the elevated thumb pad is made of rubber.

14. The multi-compartment smoking pipe of claim 1 wherein the air flow plate is removable from the interior of the main storage body.

* * * * *